US006463774B2

(12) United States Patent
Sokurenko

(10) Patent No.: US 6,463,774 B2
(45) Date of Patent: Oct. 15, 2002

(54) PUSH LOCK

(75) Inventor: William E. Sokurenko, Glen Mills, PA (US)

(73) Assignee: Southco, Inc., Concordville, PA (US)

( * ) Notice: Subject to any disclaimer, the term of this patent is extended or adjusted under 35 U.S.C. 154(b) by 0 days.

(21) Appl. No.: 09/801,395

(22) Filed: Mar. 8, 2001

(65) Prior Publication Data

US 2001/0045114 A1 Nov. 29, 2001

Related U.S. Application Data

(63) Continuation-in-part of application No. 09/572,358, filed on May 17, 2000, now abandoned.

(51) Int. Cl.[7] ..... E05B 9/08

(52) U.S. Cl. ..... 70/360; 70/361; 70/370; 292/DIG. 37

(58) Field of Search ..... 70/360, 361, 370, 70/DIG. 36; 292/DIG. 37

(56) References Cited

U.S. PATENT DOCUMENTS

| | | | | | |
|---|---|---|---|---|---|
| 529,388 | A | * | 11/1894 | Johnston | 70/361 |
| 925,455 | A | * | 6/1909 | Campbell | 292/DIG. 37 X |
| 1,186,803 | A | * | 6/1916 | Kurtzon | 292/DIG. 37 X |
| 2,086,034 | A | * | 7/1937 | Jacobi | 292/DIG. 37 X |
| 2,313,711 | A | | 3/1943 | Jacobi | 292/DIG. 37 X |
| 2,313,712 | A | * | 3/1943 | Jacobi | 292/DIG. 37 X |
| 3,604,230 | A | | 9/1971 | Tixier | 70/370 X |
| 3,677,591 | A | | 7/1972 | Waldo | 292/DIG. 37 X |
| 3,919,866 | A | * | 11/1975 | Lipschutz | 70/81 |
| 5,722,275 | A | | 3/1998 | Price et al. | 70/360 X |

FOREIGN PATENT DOCUMENTS

| | | | | |
|---|---|---|---|---|
| DE | 2351975 | * | 4/1974 | 70/361 |

* cited by examiner

*Primary Examiner*—Lloyd A. Gall
(74) *Attorney, Agent, or Firm*—Paul & Paul

(57) ABSTRACT

A push lock assembly having a housing with mounting elements for mounting the push lock to a mounting surface, a pawl carried on the housing, an actuating knob, a cam member and a lock plug which is carried in the actuating knob and associated with the cam member for rotation thereof, the mounting elements facilitating mounting of the push lock from single side of a panel.

21 Claims, 9 Drawing Sheets

PUSH LOCK

CROSS REFERENCE TO RELATED APPLICATION

This application is a Continuation-In-Part application of U.S. Ser. No. 09/572,358 filed May 17, 2000 (now abandoned).

BACKGROUND OF THE INVENTION

1. Field of the invention

The present invention relates generally to a latching assembly and more particularly to a push lock which is depressed to release a latching member.

2. Background of the Invention

There are various ways of accomplishing latching through the use of an actuator and a pawl. Generally, an actuator is provided to be lifted, swung, or pressed. The moving of the actuator, in turn, ultimately acts to displace a pawl from a first position to a second position where latching or unlatching occurs.

For example, some latches have an actuating member which is partially enclosed in a housing, and can be retracted or extended relative to the housing. In these types of designs, the latch is often mounted by providing threads on the housing, and inserting the housing through a panel bore, and securing the housing with a matingly threaded nut. This type of mounting arrangement requires access to the rear surface of the panel when installing, repairing or replacing the latch. For example, where an unauthorized user has tampered with a latch which has been installed in a finished panel, and causes the latch to need replacement, it is sometimes very difficult and time-consuming to remove the broken latch on the panel and replace it with a new one, or to repair the damaged components.

For example, in some applications, a latch may be installed onto a panel and the panel attached to a mounting cabinet. Space may be minimal, and access to the rear of a latch, in order to mount the latch, and the use of additional mounting members, such as, for example, a nut, may be difficult to do.

Furthermore, often latches are used in connection with vehicle storage and compartment panels. Therefore, in many cases, other panels and finishing materials must be first removed before the latch can be installed or removed.

In addition, where molded, one-piece compartments are utilized, it is often impossible to remove panels, and generally the latch must be installed in the confines of the space provided.

A need therefore exists for a latch which can be used for mounting in situations where it may be difficult, or even impossible, to access the rear portion of the latch.

SUMMARY OF THE INVENTION

A push lock assembly having a housing with mounting means for mounting the assembly to a mounting surface, a pawl which is retractable to engage and disengage with a keeper or other element, a cam member which is regulated with a lock plug to engage a pawl, and an actuation member which can be operated by a user to cause the pawl to release from the keeper. The present push lock provides a snap-in mounting feature which enable it to be installed in a panel opening from a single side.

The push lock of the present invention is provided for use with commercially available lock plug inserts, including, for example, lock plug inserts which have a push-in type operation. With these lock plugs, the present push lock provides a cam feature which interacts with the lock plug when the actuator knob is depressed.

The push lock of the present invention can be used in connection with automobiles, including, for example, ignition, door, trunk, and glove box compartments.

An object of the present invention is to provide a push lock which is useful for regulating the positioning of a pawl for engagement with a keeper or other member.

It is another object of the present invention to provide a push lock which can be installed completely from a single side of a panel or member to which it is to be mounted.

Another object of the present invention is to provide a push lock which can be used with a commercially available lock plug.

Another object of the present invention is to provide an interactive element which engages with a locking element of a lock plug.

Another object of the present invention is to provide mounting elements which can be compressed for insertion into a panel aperture and which can return to a position which grips a surface of a panel.

Another object of the present invention is to provide a push lock which can seal over a panel opening.

These and other objects of the present invention will become more readily apparent when taken into consideration with the following description and the attached drawings.

DESCRIPTION OF THE DRAWING FIGURES

DETAILED DESCRIPTION OF THE PREFERRED EMBODIMENTS

Figure 2:
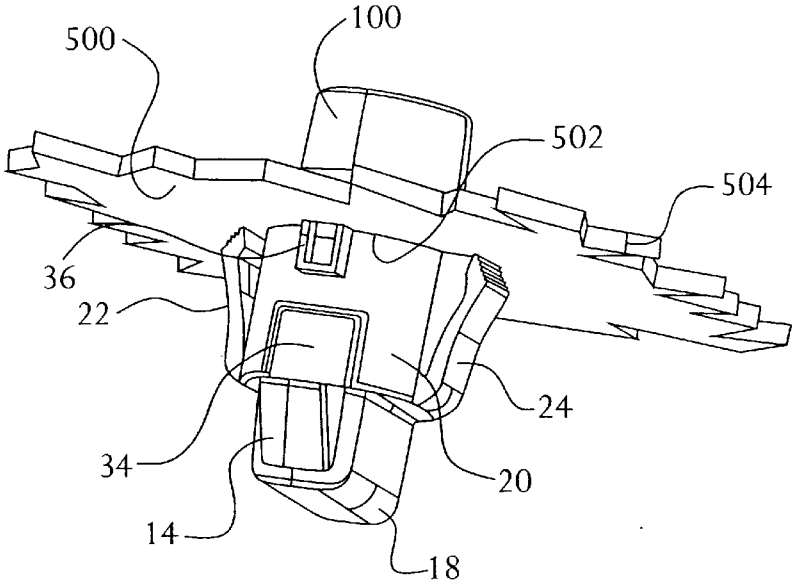
FIG. 2 is a parallel perspective view of the push lock of FIG. 1, viewed from the bottom, shown installed in a panel.
Figure 1:
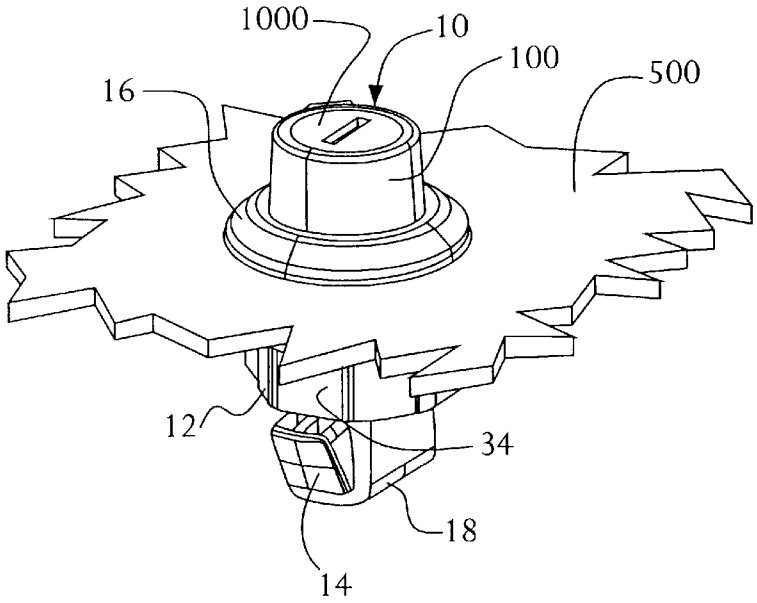
FIG. 1 is a perspective view of a push lock according to the present invention, viewed from the top of the lock, shown installed in a panel.
Figure 3:
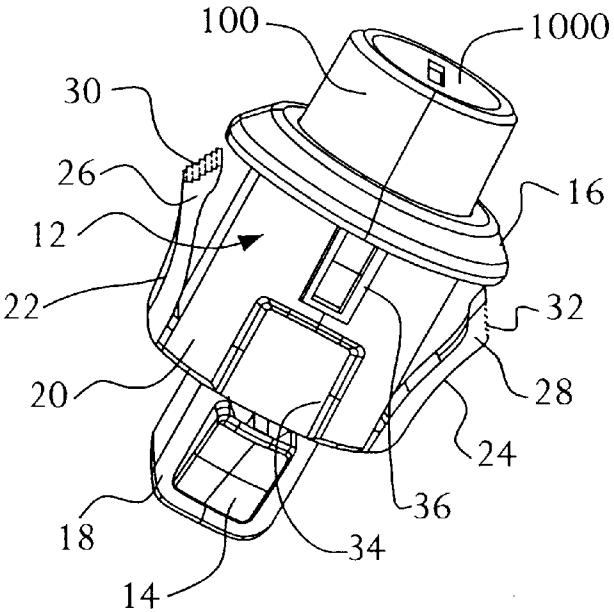
FIG. 3 is a parallel perspective view of the push lock of FIG. 1.

Referring now to the drawing figures, there is shown in FIGS. 1–3, a push lock 10 according to the present invention, having a housing 12, and a pawl member 14, shown with a standard commercially available lock plug 1000.

The housing 12 has an outer flange 16, a pawl carrier portion 18, a body portion 20, and a mounting means for mounting the push lock 10 onto a mounting surface, such as, for example, a panel 500. The mounting means is shown preferably comprising a pair of spring leg members 22, 24 which are connected to the housing body portion 20 at one end thereof, and which have a free end 26, 28, respectively, for gripping the panel 500. Preferably, the free end of each leg member 26, 28 includes gripping means for gripping a panel surface and for facilitating retention of the push lock 10 into the panel against tampering or unauthorized attempts to gain access to the locked item. The gripping means preferably can comprise ridged surface portions 30, 32 provided on each free end 26, 28 respectively, of the push lock 10 (FIG. 3).

Referring to FIG. 3, the housing 12 has a notched portion 34 provided in the housing body 20 in front of the pawl member 14, to provide clearance for the pawl.

Figure 4:
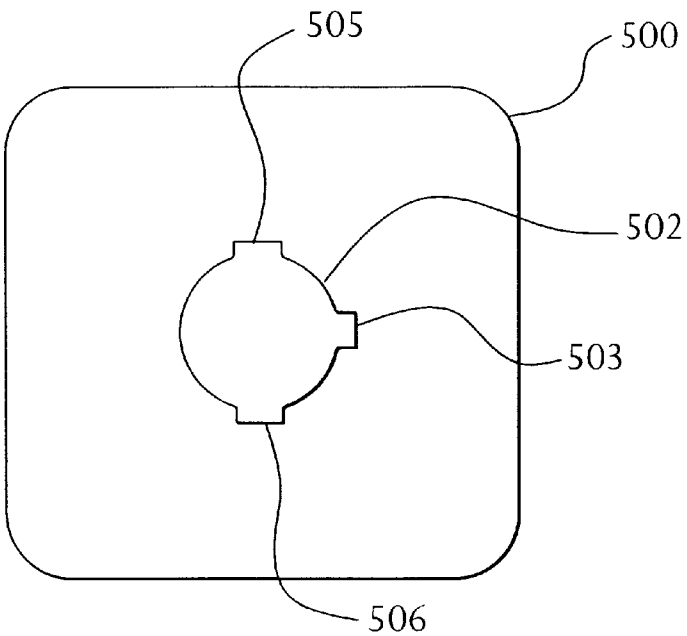
FIG. 4 is a top plan view of a panel prepared for receipt of the push lock according to the present invention.

Alignment means is provided to align the push lock 10 with respect to a mounting aperture 502 provided in the panel 500. The alignment means preferably comprises a raised locating element 36 disposed on the housing body 20. For example, the mounting aperture 502 has an indented section 503 (see FIG. 2) which corresponds with the raised locating element 36. As shown in FIG. 4, preferably, the panel aperture 502 has a pair of opposing notches 505, 506 in which the spring leg members 22, 24 respectively, are inserted for installation. When the spring leg members 22, 24 have cleared the panel thickness 504, they return to their original position and locate beyond the diameter of the notches 505, 506.

Figure 5:
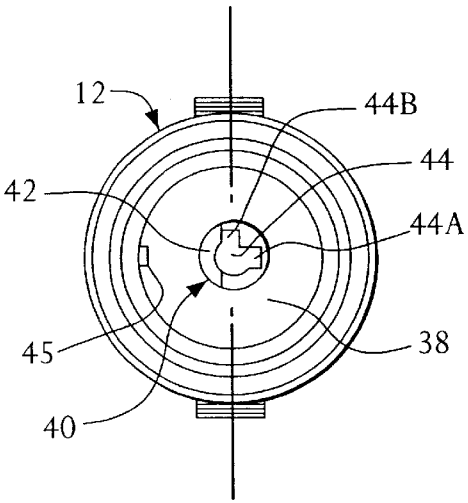
FIG. 5 is a top plan view of the housing of a push lock according to the present invention.
Figure 7A:
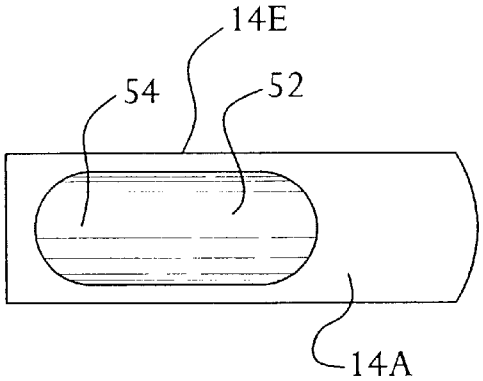
FIG. 7A is a top view of the pawl member of FIG. 7.
Figure 7C:
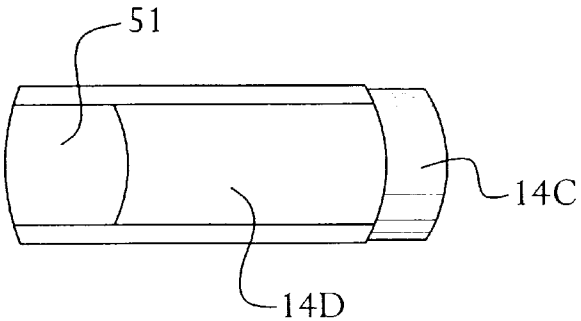
FIG. 7C is a bottom view of the pawl member of FIG. 7.
Figure 7:
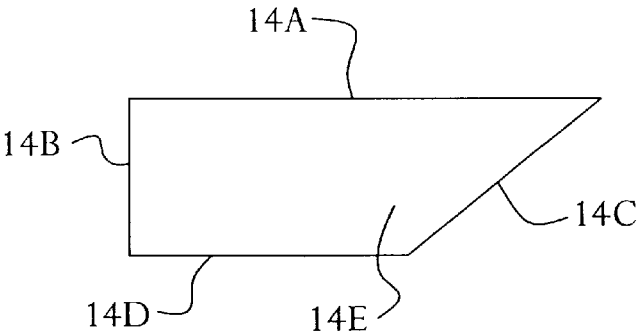
FIG. 7 is a side view of the pawl member of the push lock according to the present invention.
Figure 7B:
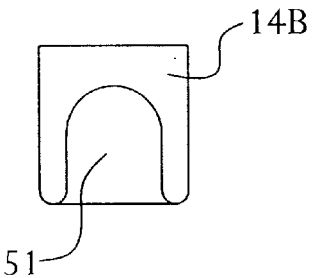
FIG. 7B is a rear view of the pawl member of FIG. 7.
Figure 15:
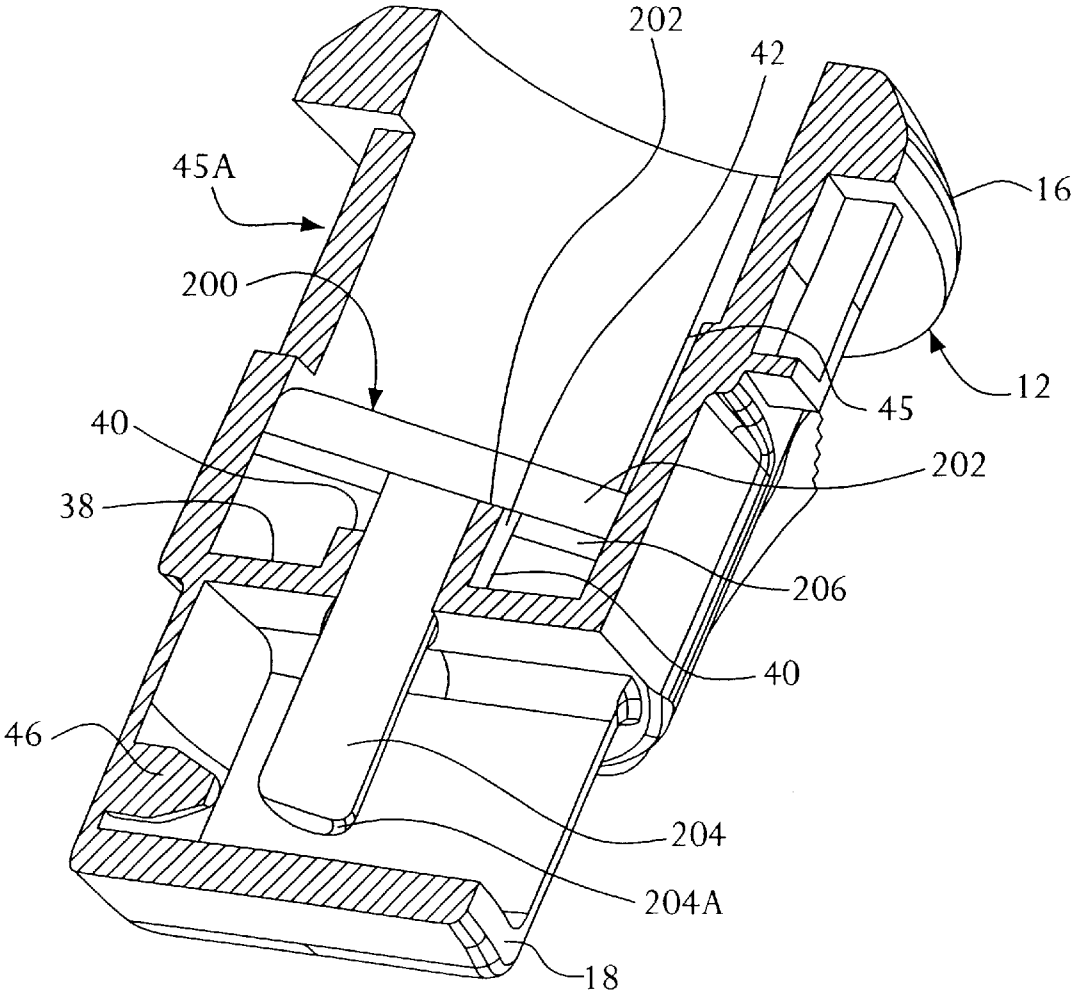
FIG. 15 is a side perspective view of the push lock showing the housing in a sectional view with the cam member received in the housing in the plunged position.

Referring to FIG. 5, on the housing floor 38 is provided a stop means for regulating the rotational movement of the lock plug 1000 relative thereto. The stop means is comprised of a base portion 40 having a sleeve 42 and an L shaped aperture 44. The L shaped aperture has a first slot 44A substantially perpendicular to the sleeve 42 and a second slot 44B substantially parallel to the sleeve 42. The body portion 20 of the housing 12 is continuous with the carrier portion 18 through the L shaped aperture 44, this feature being necessary for actuation of the latch discussed below. Further, a boss 45 is provided on the interior body of the housing 20 for alignment and of the knob member 100 during assembly of the push lock 10 and retention of the cam member when assembled. As best illustrated in FIG. 15, opposite of the boss 45, on the interior body of the housing 20, is a groove 45A which is necessary for retention of the cam member 100 discussed below.

Figure 6:
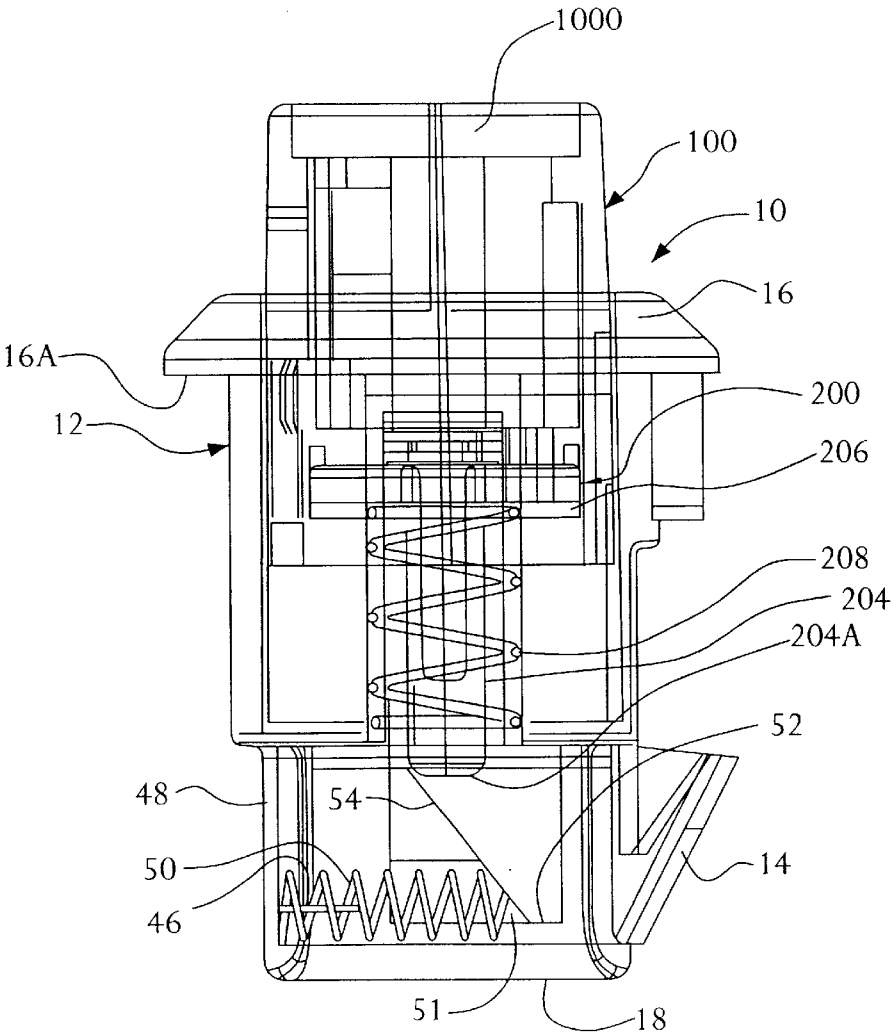
FIG. 6 is a right side sectional view of the push lock of FIG. 1.

Referring to FIGS. 6, 7 and 7A–7C, the carrier portion 18 of the housing 12 is shown with the pawl member 14 carried therein. The pawl member has a top surface 14A, a rear surface 14B, a diagonal shaped front surface 14C, a bottom surface 14D and two identical sides 14E. A spring mounting post 46 is disposed on the floor 48 of the pawl-carrying portion 18 of the housing 12. A compression spring 50 is impaled on the spring mounting post 46 and inserted into a pawl recess 51 located on the rear surface 14B of the pawl member 14. The compression spring 50 biases the pawl 14 into its extended position, as shown in FIG. 6. The pawl member 14 has a groove 52 disposed therein accessible through the top surface 14A formed in part by a sloped surface 54. The groove 52 and sloped surface 54 are integral in the actuation of the push lock 10 described below.

Figure 8:
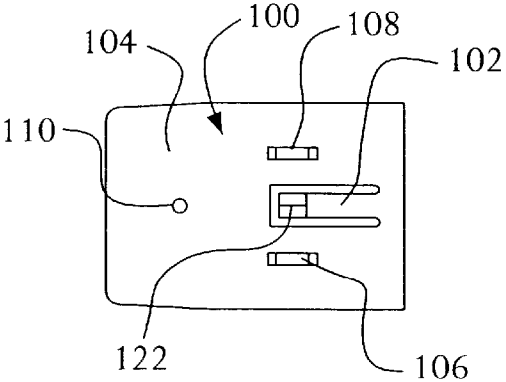
FIG. 8 is a separate side elevation view of a knob member of the push lock of FIG. 1.

Referring to FIG. 8, the push lock 10 has a knob member 100 which receives a lock plug 1000 therein and which is inserted within the housing 12 and connected thereto. The knob member 100 is shown in FIG. 8 having a connecting means for attachment to the housing 12. The connecting means is shown comprising a snap leg member 102 disposed on the knob body portion 104. Positioning elements 106, 108 are disposed on the body portion 104, on opposite sides of the snap leg member 102. An aperture 110 is disposed in the knob body portion 104 for permitting access to the lock plug 1000 to release the lock plug 1000 from the knob member 100, should it be necessary to do so.

Figure 10:
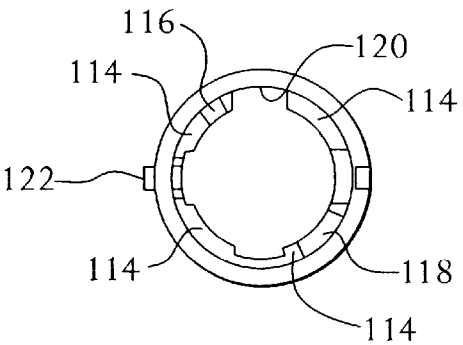
FIG. 10 is a bottom plan view of knob member for use with the housing shown in FIG. 5.
Figure 9:
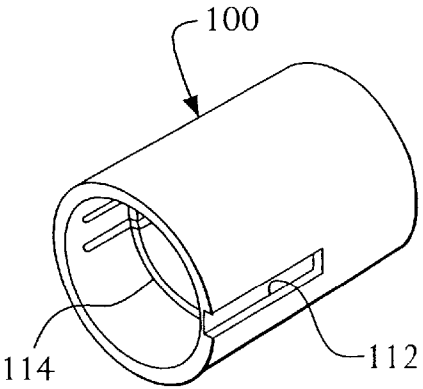
FIG. 9 is a separate parallel perspective view of the knob member of FIG. 8.

Referring to FIGS. 9 and 10, the knob member 100 has a longitudinal groove 112 disposed thereon. This groove 112 mates with the boss 45 on the inner surface of the housing body 20 to retain the knob member 100 against rotation relative to the housing 12. A circumferential ledge port 114 is provided on the interior of the knob member 100 and configured with recesses 116, 118 to facilitate retention of a cam member 200. A channel 120 interrupts the circumferential ledge part 114 for acceptance of the lock plug 1000 discussed below.

Figure 12:
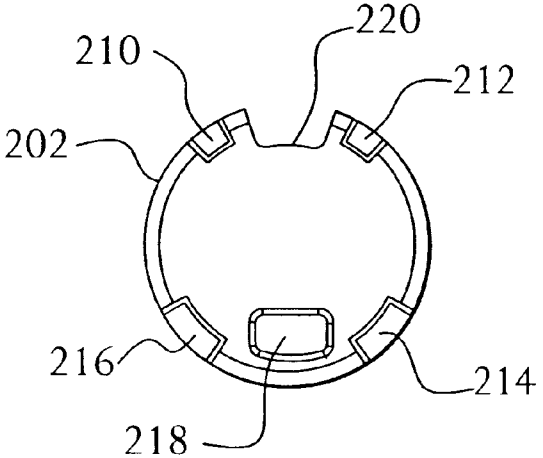
FIG. 12 is a top view of the cam member of FIG. 11.
Figure 11:
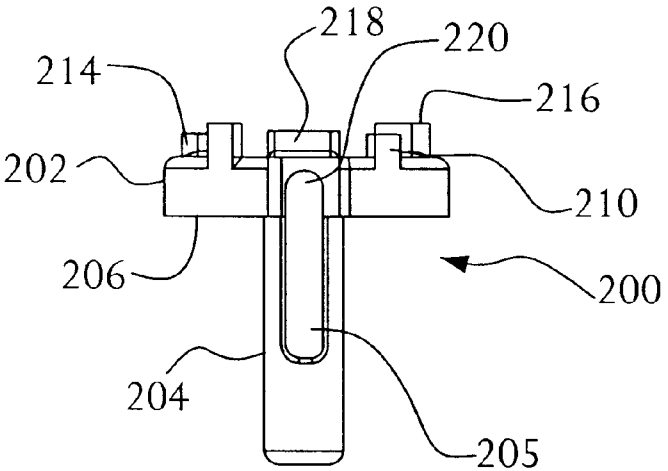
FIG. 11 is a side view of the cam member of the present invention.

The cam member 200 is shown in FIGS. 11 and 12 having a head 202 and a post 204 having an attached arm 205 extending there from. The head portion 202 is surrounded by a flange 206 for aligning the lock plug spring 208 (see FIG. 6) for maximum efficiency of the lock plug spring 208 during compressing (discussed below). The cam member head 202 has teeth 210, 212, 214 and 216 extending upwardly there from. The cam head 202 has a boss 218 for aligning the lock plug 1000 with the channel 220 of the cam member 200. The circumferential flange 206 is interrupted by a channel 220 which is aligned with the channel 120 of the knob member 100 during assembly. The alignment of the knob channel 120 with the channel 220 of the cam member 200 allows for the lock plug tooth 1002 to be inserted to direct the movement of the lock plug 1000 and cam member 200 during actuation of the push lock 10 discussed below.

The push lock is assembled by construction of two assemblies, a housing assembly and an interior assembly, both consisting of the recited components. The interior assembly consists of the knob member 100, the cam member 200 and the lock plug spring 208. The housing assembly consisting of the housing 12, pawl member 14 and pawl compression spring 50.

The interior assembly is constructed by aligning teeth 210 and 214 of the cam member 200 with the recesses 116 and 118 of the knob member 100. This alignment will coordinate the cam member channel 220 with the channel 120 of the knob member 100. The lock plug spring 208 is installed against the head 202 of the cam member 200 within the flange 206 encircling the cam post 204. The housing assembly is constructed by aligning the pawl compression spring 50 of the pawl carrier portion 18 with the pawl recess 51 of the pawl member 14. As stated above, the opposite end of the compression spring 50 is impaled on the spring mounting post 46.

Combining the two assemblies to form the push lock 10 is accomplished by holding the pawl member 14 of the interior assembly in a retracted position against the tension of the compression spring 50 and inserting the interior assembly within the housing body 20 of the housing assembly aligned by the groove 45A of the housing 12. The snap leg 102 of the knob member 100 is held in the retracted position by the housing 20, until the snap leg 102, is completely within the groove 45A and thus snapped into the housing body 20 when the snap leg 102 returns to the relaxed position. The expanded (or relaxed) snap leg 102 is held in position by a lipped end 122 of the snap leg 102 against the underside 16A of the flange 16 of the housing 12.

The assembled push lock 10 is configured to receive a lock plug 1000. For example, the lock plug 1000 can be of the type which can be rotated a predetermined amount after insertion into the knob member 100, to secure the lock plug 1000 thereto. This can be accomplished wherein a locking wafer (not shown) of the lock plug 1000 moves into position to prevent the lock plug 100 from being rotated to a releasing position relative to the knob member 100 in which it is installed.

Figure 13:
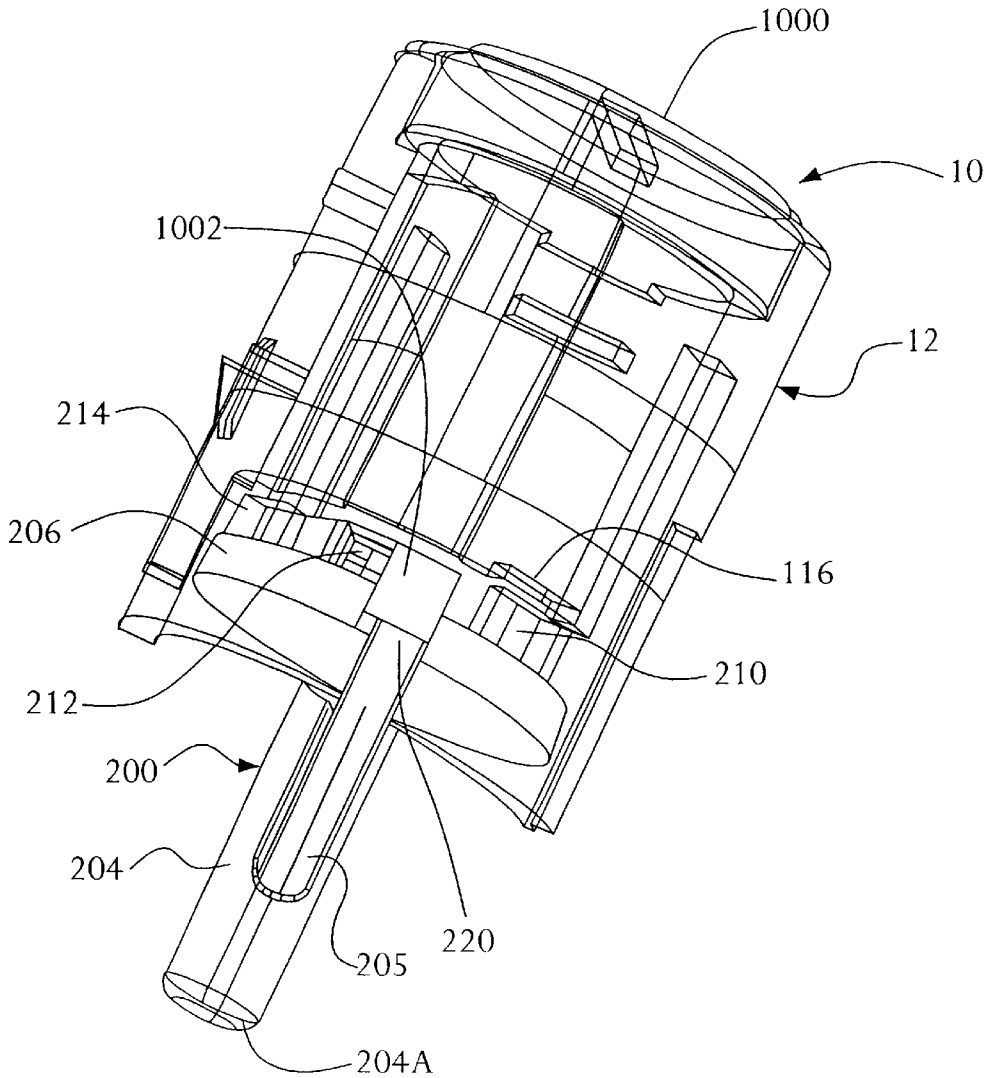
FIG. 13 is a side view of the push lock according to the present invention, showing the knob, cam member, and lock plug assembled (the housing, pawl, and springs not being shown).
Figure 14:
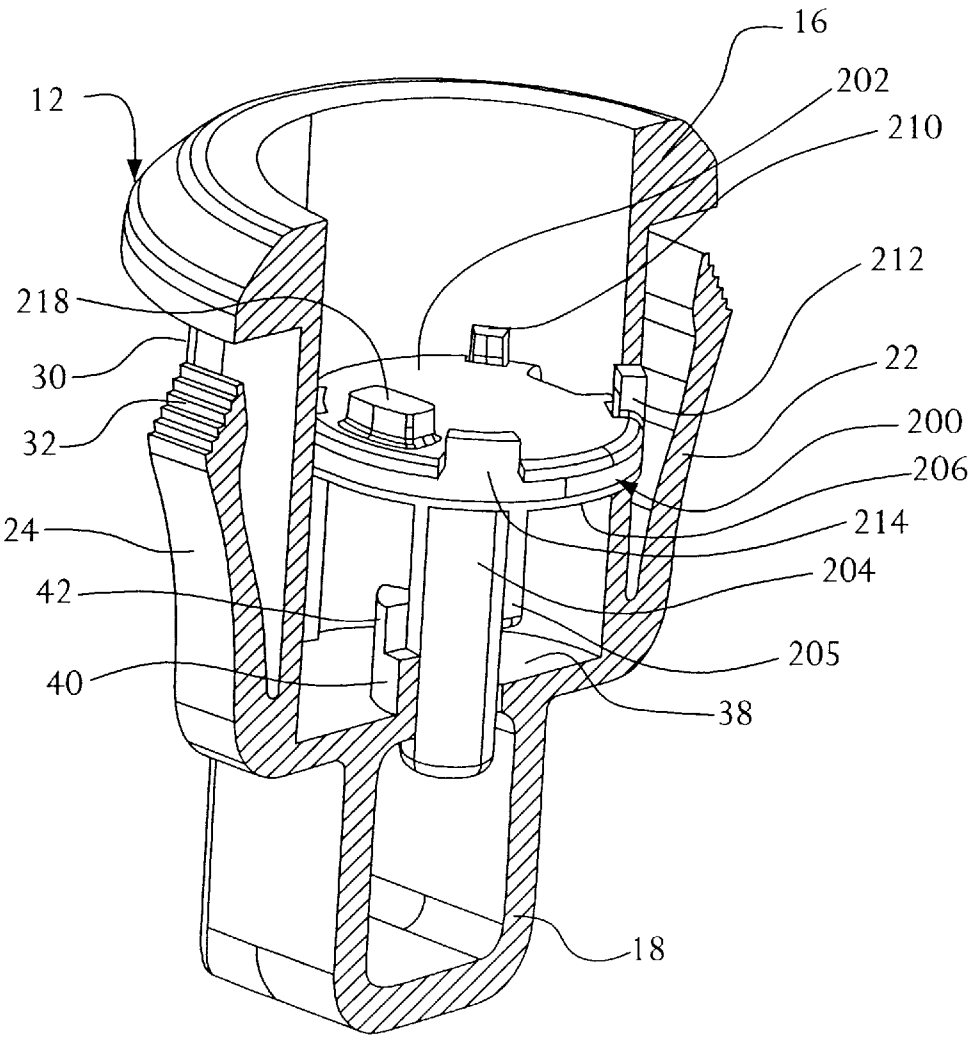
FIG. 14 is a side perspective view of the push lock showing the housing in a sectional view with the cam member received in the housing.

Referring to FIGS. 13–15, when the lock plug 1000 is installed, it is then rotated counterclockwise a quarter turn, thereby, the cam member 200 cannot return to a position where the cam post arm 205 aligns with the parallel opening 44B. As stated above, the lock plug 1000 is held in place by a locking wafer (not shown) prohibiting the rotation in a counterclockwise direction. This permits the lock plug 1000 to be installed with the push lock 10 in the unlocked position so the pawl 14 can be released. Thus, the push lock 1000 can only be operated when the cam post arm 205 is aligned with the perpendicular opening 44A. Release of the lock plug 1000 necessitates compression of the locking wafer (not shown) through the aperture 110.

Actuation of the push lock is permitted by the perpendicular opening 44A which permits the lowering of the cam post 204 to actuate the pawl member 14 and retract it. The sleeve 42 of the base 40 is provided to partially surround the post 204 of the cam member 200, and, as shown best in FIGS. 14 and 15, acts as a stop means for rotation and alignment of the cam member 200.

As best illustrated if FIGS. 13 and 15, retraction of the pawl member 14 occurs when the cam post 204 is depressed through slot 44A of the housing 12 and enters the pawl carrier portion 18. Within the pawl carrier portion 18, the end of the cam post 204A contacts the sloped area 54 of the pawl groove 52 and slides downward forcing the pawl member 14 to retract against the bias of the spring 50.

Rotating the lock plug 1000 another quarter turn from the actuation position, places the lock plug 1000 in the locked position. Rotation is stopped by the cam post arm 205 contacting the sleeve 42 of the base 40. In the locked position, the cam post arm 205 is at a position 180 degrees from the lock plug 1000 installation position (aligned with the parallel section 44B). At this position no slot exists in the base 40. Thus, the cam member post 204 cannot be depressed to contact the pawl member 14 because the cam post arm 205 is in contact with the base 40.

Other modifications to the above description can be made consistent with the spirit and scope of the invention disclosed herein. In addition, it will be understood that the present handle assembly can be employed in conjunction with other panels and closure members, including, for example, lift-off panels, sliding panels, joining panels, folding panels and the like. These and other advantages of the present invention can be made consistent with the spirit and scope of the invention as disclosed in the Summary of the Invention, the Brief Description of the Drawing Figures, and the Detailed Description of the Preferred Embodiments. While the above description constitutes the preferred embodiment of the present invention, it will be appreciated that the invention is subject to modification, variation and change, without departing from the proper scope or fair meaning of the present invention.

I claim:

1. A push lock for attaching a panel member to a frame comprising:

a housing having a hollowed interior and exterior body portion, said interior body portion continuous through a floor section with a hollowed pawl member portion;

a knob member having a connection means for attachment to said housing wherein said knob member is adapted to receive a lock plug therein, wherein said knob member has a stop means for retarding rotation of said knob member during actuation of the push lock;

a cam member having a head member having a first side and a second side, wherein said first side is surrounded by a cam head flange, wherein said first side has a post member and cam arm extending there from, wherein said second side has a plurality of teeth extending there from;

a cam spring placed within said cam head flange of said cam head for biasing said cam member during actuation;

a pawl member having a top portion, bottom portion, rear portion, a diagonal front portion and identical side portions; and a pawl spring for biasing said pawl member during actuation of the push lock.

2. The push lock of claim 1, wherein said exterior body portion has spring legs for attachment to a panel.

3. The push lock of claim 1, wherein said exterior body portion has a flange encircling said hollowed interior portion.

4. The push lock of claim 1, wherein said pawl member portion of said housing has a spring mounting post for attachment of said pawl spring.

5. The push lock of claim 4, wherein said pawl member has a pawl spring recess accessible from said rear or bottom portion, wherein said pawl member is biased by said pawl spring which is impaled on said spring mounting post and against said pawl spring recess.

6. The push lock of claim 1, wherein said housing has a groove for attachment of said connection means of said knob member.

7. The push lock of claim 6, wherein said connection means of said knob member is a snap leg.

8. The push lock of claim 1, wherein said interior body portion has a boss for mating with said stop means of said knob member.

9. The push lock of claim 8, wherein said stop means is a groove on said knob member.

10. The push lock of claim 1, wherein said exterior body portion has an indented portion for clearance of said pawl member.

11. The push lock of claim 1, wherein said exterior body portion has a raised locating element.

12. The push lock of claim 1, wherein said knob member has an aperture for access to a lock plug locking wafer.

13. The push lock of claim 1, wherein said knob member has a circumferential ledge, wherein said circumferential ledge has recesses therein for alignment of said teeth of said cam member for receiving a lock plug.

14. The push lock of claim 13, wherein said circumferential ledge is interrupted by a channel.

15. The push lock of claim 14, wherein said cam head flange is interrupted by a channel, wherein said cam head channel is aligned with said channel of said circumferential ledge of said knob member for acceptance of a lock plug tooth.

16. The push lock of claim 1, wherein said interior body portion has a base member located on said housing floor having an aperture there through.

17. The push lock of claim 16, wherein said base member aperture is L-shaped.

18. The push lock of claim 17, wherein said base member has a sleeve extending there from, wherein said sleeve limits rotation of said lock plug during actuation.

19. The push lock of claim 18, wherein said L-shaped aperture allows for the penetration of said cam post member and said cam arm to actuate said pawl member.

20. The push lock of claim 19, wherein said pawl member has a cam post recess accessible from said top portion of said pawl member, wherein said recess has a diagonal element therein; wherein said cam post member contacts said diagonal element for retraction of said pawl member during actuation of the push lock.

21. A push lock for attaching a panel member to a frame comprising:

a housing having a hollowed interior and exterior body portion, said interior body portion continuous through a floor section with a hollowed pawl member portion;

a knob member having a connection means for attachment to said housing wherein said knob member is adapted to receive a lock plug therein;

a cam member having means axially extending there from for engaging with said knob member;

a cam spring for biasing said cam member during actuation;

a pawl member; and a pawl spring for biasing said pawl member during actuation of the push lock.

* * * * *